US005923209A

United States Patent [19]

Price et al.

[11] Patent Number: 5,923,209

[45] Date of Patent: Jul. 13, 1999

[54] TWO TRIM CURRENT SOURCE AND METHOD FOR A DIGITAL-TO-ANALOG CONVERTER

[75] Inventors: Burt L. Price, Apex, N.C.; Bruce J. Tesch, Melbourne, Fla.

[73] Assignee: Harris Corporation, Melbourne, Fla.

[21] Appl. No.: 08/707,380

[22] Filed: Sep. 4, 1996

[51] Int. Cl.[6] ..... G05F 1/10

[52] U.S. Cl. ..... 327/538; 327/545; 323/312

[58] Field of Search ..... 327/538, 545; 323/312, 315

[56] References Cited

U.S. PATENT DOCUMENTS

| | | | |
|---|---|---|---|
| 4,055,773 | 10/1977 | Schoeff | 307/229 |
| 4,766,366 | 8/1988 | Davis | 323/312 |
| 4,931,665 | 6/1990 | Yee | 307/296.6 |
| 5,049,834 | 9/1991 | Kasai | 330/255 |
| 5,281,866 | 1/1994 | Rundel | 307/296.3 |
| 5,300,877 | 4/1994 | Tesch | 323/313 |

*Primary Examiner*—Timothy P. Callahan
*Assistant Examiner*—An T. Luu
*Attorney, Agent, or Firm*—Rogers & Killeen

[57] ABSTRACT

A trimmable current cell and method for providing an output current at a desired level which may be used to provide a particular current level for a digital-to-analog converter. The cell includes a first circuit with two fixed resistors connected in series which initially establish the output current, and a second circuit for trimming the output current from the first circuit to the desired level. The second circuit has a series-connected pair of trimmable resistors whose common node is connected to the first circuit at a common node between the fixed resistors. Trimming one of the trimmable resistors increases the output current to the desired level and trimming the other of the trimmable resistors decreases the output current to the desired level.

20 Claims, 1 Drawing Sheet

TWO TRIM CURRENT SOURCE AND METHOD FOR A DIGITAL-TO-ANALOG CONVERTER

BACKGROUND OF THE INVENTION

The present invention relates to current cells for providing precisely controlled currents, and more particularly to a current cell and method for providing a specified current for a digital-to-analog converter.

The need to provide a precise amount of current is found in many types of electronic devices, including a digital-to-analog converter (DAC) in which an incorrect translation of a digital input bit to a current can cause an inaccurate output. A DAC, for example, may include over 20 current sources with transistors and resistors. A mismatch among these components can cause an undesirable nonlinear output from the DAC.

Electronic devices which require precise currents include components such as the transistors and resistors which are manufactured in processes which may not be sufficiently accurate to provide the precise current required. To this end, the art has developed so that corrective steps are included in the manufacturing process of such devices which obviate the inaccuracies of the processes. The corrective steps include changing the resistance of the resistors which are influential in determining current accuracy.

A resistor is typically manufactured with a resistance that is not sufficiently precise for electronic devices, such as DACs, which require precise currents. However, during the device manufacturing process the resistance of the resistor can be changed by trimming so that it does provide sufficiently accurate current. Trimming typically involves the physical removal of a portion of the resistor, such as with a laser, so that the resistor's resistance increases. Physical trimming requires that the device be tested and trimmed before it is enclosed, and the testing, trimming and enclosure steps can introduce further inaccuracies. Further, resistance cannot be decreased through physical trimming and thus every current cell in a DAC must be trimmed so that the output current matches the output current from the lowest untrimmed cell.

Trimming may also be electronic in that current may be added or removed through extra circuitry which is added to the electronic device specifically to do the trimming. Electronic trimming may be carried out after the device is enclosed and may increase or decrease current, but the trimming circuitry takes up valuable space and uses leads which are not otherwise available for substantive functions.

Accordingly, it is an object of the present invention to provide a novel current cell and method in which the need to trim resistors is reduced and in which physical trimming may either reduce or increase output current so as to obviate the problems of the prior art.

It is another object of the present invention to provide a novel cell and method for providing an output current at a desired level by physically trimming one or the other of two series connected trimmable resistors to increase or decrease the output current to the desired level.

It is yet another object of the present invention to provide a novel cell and method for providing a desired current level in which a first circuit reduces deviation of the output current from the desired level, the first circuit having a pair of series-connected fixed resistors, and in which a second circuit has a series-connected pair of trimmable resistors, one or the other of which may be trimmed to adjust the output current from the first circuit to the desired level.

It is still another object of the present invention to provide a novel method and cell for providing a desired current level in which the cell has a first circuit with plural transistors having a control terminal at a first potential and collectors connected to an output current node, each of the first transistors having a second terminal connected to an end of a different one of plural series-connected pairs of untrimmed resistors, wherein each of the pairs of untrimmed resistors is connected to every other of the pairs at a common node between the untrimmed resistors, and in which a second circuit for trimming the output current from the first circuit to the desired level includes a transistor having a first terminal connected to an end of a series-connected pair of trimmable resistors, in which a common node of the pair of trimmable resistors is connected to the common node of the pairs of untrimmed resistors.

It is yet a further object of the present invention to provide a novel method and cell for providing a desired current level in which the cell provides an output current from a current switch at the desired level, and in which a cascode transistor establishes a common $V_{CE}$ for the transistors in the cell.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
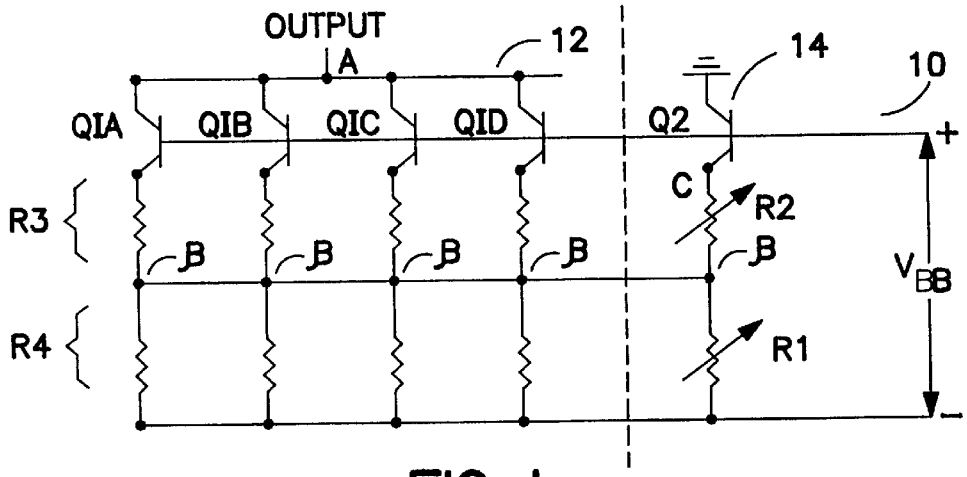
FIG. 1 is a circuit diagram of an embodiment of the present invention.

With reference now to FIG. 1, an embodiment of the present invention may be a trimmable current cell 10 for providing an output current at a desired level at output current node A. The cell may be one of many similar cells for providing precise currents for a DAC, and may find application in a variety of other electronic devices which need precisely controlled currents.

Cell 10 may include a first circuit 12 for providing an output current at node A which is approximately at the desired level. First circuit 12 may include plural first transistors Q1A–D having control terminals (bases for the bipolar junction transistors shown, although the invention is not limited to bipolar junction transistors) at a first potential and first terminals (collectors) connected to the output current node A. Each of first transistors Q1A–D may have a second terminal (emitter) connected to an end of a different one of plural series-connected pairs of first resistors R3–4. Each pair of first resistors R3–4 may be connected to the other pairs of resistors R3–4 at a common node B between the resistors, and may be connected at an end remote from first transistors Q1A–D which may be at a second potential ($V_{BB}$—in the illustrated example.) Resistors R3–4 need not be trimmed at all and may have a fixed resistance. It has been found that plural pairs of the fixed resistors reduce deviation of the output of first circuit 12 from the desired current level by "averaging" the deviations of the individual pairs. In a preferred embodiment, there are four pairs of fixed resistors in first circuit 12, although the invention is not so limited as fewer or more fixed resistors may be provided as needed, and one pair is sufficient for the present invention.

Cell 10 may also include a second circuit 14 for trimming the output current from first circuit 12 to precisely the desired level. Second circuit 14 may include a second transistor Q2 having its control terminal at the first potential, and its first terminal connected to an end of a series-connected pair of second resistors R1–2. Resistors R1–2 may be connected to common node B between resistors R1–2 and may have an end remote from transistor Q2 at the second potential.

In operation, first circuit 12 initially provides at node A an output current which is approximately at the desired level by relying on the plurality of resistors R3–4 to statistically reduce the variation between currents produced by each set of transistor Q1 and corresponding resistors R3–4. The desired current level may be achieved at node A by trimming one of resistors R1–2 in second circuit 14 to either increase or decrease the output current so the current at node A is at the desired level. Trimming resistor R2 increases the current at node A and trimming resistor R1 decreases the current at node A. Trimmable resistors R1–2 may be physically trimmed (e.g., with laser trimming), although trimming would not be needed at all if the current from circuit 12 is at the desired level. Even if trimming is needed, the total amount of trimming required will be reduced from the amount needed in the prior art since all current cells no longer must be trimmed to match the output current of the lowest untrimmed cell. Since the output of first circuit 12 in each cell is close to the desired current level, only cells with outputs current which are beyond an acceptable range will have to be trimmed.

Figure 2:
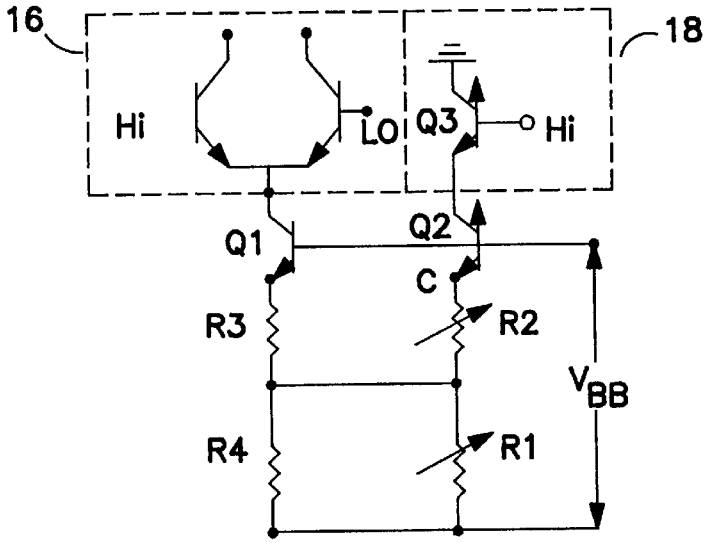
FIG. 2 is a circuit diagram of a further embodiment of the present invention.

In further a embodiment, the output current may be provided by a conventional current switch 16 (such as depicted in FIG. 2), and a cascoding circuit 18 with cascode transistor Q3 may be provided to match the $V_{CE}$ of transistors Q1 and Q2. The output (collector) current of Q3 is not used in this embodiment and may be shunted to ground.

Figure 3:
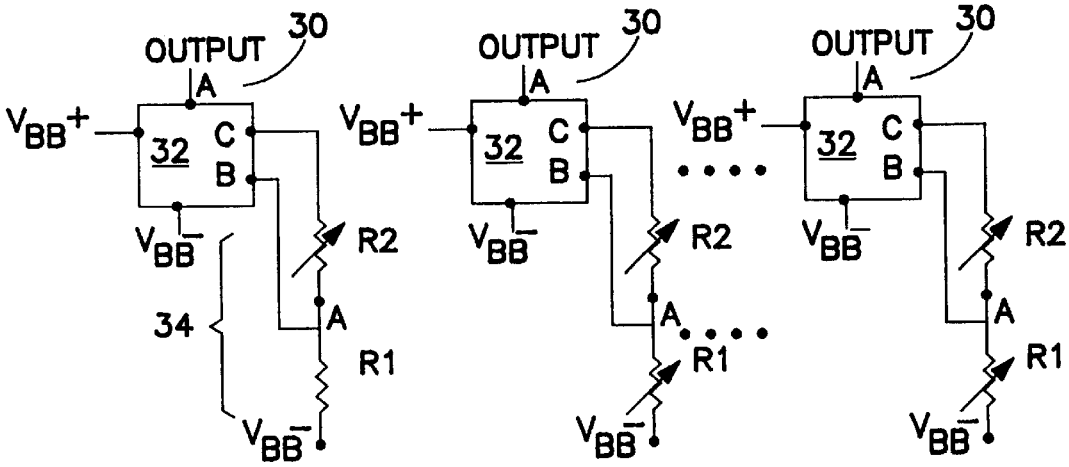
FIG. 3 is a partial block diagram and partial circuit diagram of an embodiment of the present invention for a DAC integrated circuit.

The cell and method of the present invention may be used in a DAC to provide each of the various desired current levels. With reference now to FIG. 3, a plurality of cells 30 may be provided for a DAC in an integrated circuit, where each cell may include an untrimmable portion 32 which may contain resistors R3–4 and transistors Q1 and Q2 of FIG. 1 in an enclosed package, and a trimmable portion 34 connected at nodes B and C which includes resistors R1–2. Resistors R1–2 may be exposed on the integrated circuit for ease of physical trimming.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A physically trimable IC current cell for providing an output current at a desired level comprising:

a first circuit comprising plural resistors for providing an output current at approximately the desired level at an output current node; and a second circuit for trimming the output current from said first circuit to the desired level, said second circuit comprising a series-connected pair of trimable resistors which have a first node therebetween connected to said plural resistors, whereby trimming one of said trimable resistors increases current at said output current node and trimming the other of said trimable resistors decreases current at said output current node.

2. The current cell of claim 1 wherein each of said plural resistors comprise a series-connected pair of resistors; and wherein said first node is connected between the resistors of each pair of resistors in the series-connected pair of resistors which comprise said plural resistors.

3. The current cell of claim 2 wherein said first circuit further comprises a first transistor for each of said plurality of resistors, each of said first transistors having a control terminal at a first potential, a first terminal connected to said output current node, and a second terminal connected to an end of one of said plurality of resistors.

4. The current cell of claim 3 wherein said second circuit comprises a second transistor having a control terminal at the first potential and a first terminal connected to one end of one of said trimable resistors.

5. The current cell of claim 2 wherein said second circuit comprises a transistor having a control terminal at a first potential and a first terminal connected to one end of said pair of trimable resistors.

6. The current cell of claim 5 wherein said first circuit further comprises a second transistor having a control terminal at the first potential, a first terminal for providing an output current, and a second terminal connected to one end of each series-connected pair of said plural resistors.

7. The current cell of claim 6 wherein said second circuit further comprising a cascode-connected transistor for matching the collector-emitter voltages of said first and second transistors.

8. The current cell of claim 1 wherein said first circuit further comprises a current switch.

9. The current cell of claim 1 wherein said plural resistors are spaced apart at a distance prohibiting for laser trimming.

10. An IC trimable current cell for providing an output current at a desired level comprising:

a first circuit for providing an output current at an output node comprising a plurality of parallel circuits, each of said parallel circuits comprising a first transistor in series with a first pair of fixed value resistors; and a second circuit for trimming a current at said output node comprising a second transistor in series with a second pair of resistors, all of said transistors having a common control terminal and the interconnection of all of said pairs of resistors being common, and said first pair of resistors being spaced apart a distance prohibiting laser trimming and said second pair of resistors spaced at a distance from each other and said first pair of resistors to permit laser trimming whereby trimming one of said second pair of resistors increases the current at said output node and trimming the other of said second pair of resistors decreases the current at said output node.

11. The current cell of claim 10 including a current switch connected to said output node.

12. The current cell of claim 11 wherein said second circuit includes a second cascode transistor with a control terminal operable in coordination with said current switch.

13. A method of providing an output current at a desired value comprising the steps of:

(a) providing a plurality of first circuits each providing approximately the desired fraction of the output current and each having resistors spaced apart from certain other components to permit trimming of the output current to the desired value by laser trimming of the resistors;

(b) interconnecting the first circuits in parallel to reduce the deviation of the output current from the desired value; and (c) providing a second circuit having resistors spaced from all other circuit components to permit the laser trimming thereof; and (c) interconnecting the first and second circuits in a manner so that the output current of the first circuit may be trimmed to the desired value by physically trimming one of the resistors of the second circuit.

14. The method of claim 13 wherein each of the plural circuits include a first transistor;

wherein the second circuit includes a second transistor and a cascode transistor; and including the steps of:

(a) interconnecting the control terminals of the first and second transistors; and (b) controlling the cascode transistor to match the collector to emitter voltages of the first and second transistors.

15. A method of trimming an IC current cell to a desired current level comprising the steps of:

(a) providing an output current at approximately the desired current level by providing the output current from a first circuit which has plural series-connected fixed resistors in parallel; and either (b) physically trimming a first of two series-connected trimable resistors to increase the output current to precisely the desired level; or (c) physically trimming a second of the two resistors to decrease the output current to precisely the desired level.

16. In an integrated circuit, the method of increasing the current from a node of a constant current source, which method includes the steps of:

providing a transistor with a first resistive element and a second resistive element in the emitter circuit of the transistor; and removing a portion of the second resistive element.

17. In an integrated circuit, the method of selectively increasing or decreasing the current from a current circuit which includes a transistor with plural resistive elements in the emitter circuit thereof comprising the steps of:

(a) providing a tuning circuit having plural resistive elements;

(b) operatively coupling the current circuit with the tuning circuit; and (c) selectively removing a portion of one of the resistive elements in the tuning circuit to increase the source current and removing a portion of another one of the resistive elements in the tuning circuit to decrease the source current.

18. The method of claim 16 wherein said first resistive element includes non-adjustable resistors.

19. The method of claim 16 wherein said second resistive element includes adjustable resistors.

20. The method of claim 16 wherein said second resistive element includes adjustable resistors.

* * * * *